United States Patent [19]

Reinke

[11] Patent Number: 4,534,304

[45] Date of Patent: Aug. 13, 1985

[54] STITCH CORRECTION METHOD AND APPARATUS FOR A SEWING MACHINE

[75] Inventor: Kurt Reinke, Bielefeld, Fed. Rep. of Germany

[73] Assignee: Durkoppwerke GmbH, Bielefeld, Fed. Rep. of Germany

[21] Appl. No.: 539,676

[22] Filed: Oct. 6, 1983

[30] Foreign Application Priority Data

Oct. 6, 1982 [DE] Fed. Rep. of Germany ..... 3236932

[51] Int. Cl.[3] ..... D05B 19/00; D05B 27/22

[52] U.S. Cl. ..... 112/262.1; 112/121.11; 112/315

[58] Field of Search ..... 112/121.11, 315, 262.1, 112/314, 272, 121.12, 275, 277, 2

[56] References Cited

U.S. PATENT DOCUMENTS 4,381,719 5/1983 Goldbeck .
4,403,558 9/1983 Martell et al. ..... 112/121.11
4,404,919 9/1983 Martell et al. ..... 112/272 X

FOREIGN PATENT DOCUMENTS 0044648 3/1981 European Pat. Off. .
45-4816749 12/1970 Japan .

*Primary Examiner*—Peter Nerbun
*Attorney, Agent, or Firm*—Karl F. Ross; Herbert Dubno

[57] ABSTRACT

A photoelectric device on the head of a sewing machine detects the trailing edge of a fabric workpiece and initiates a count of pulses representing increments of the steps of displacement of the workpiece in stitch formations. Each step is subdivided into a plurality of segments which are represented by respective multiplicities of increments so that from a count of increments after detection of the reference point to a particular angular orientation of the arm shaft, a stitch combination can be drawn from a memory which will include stitches of an original length and stitches of a length reduced from the original by a fixed amount so that in the number of stitches of the selected combination the row will be completed to a certain distance from the reference edge.

11 Claims, 3 Drawing Figures

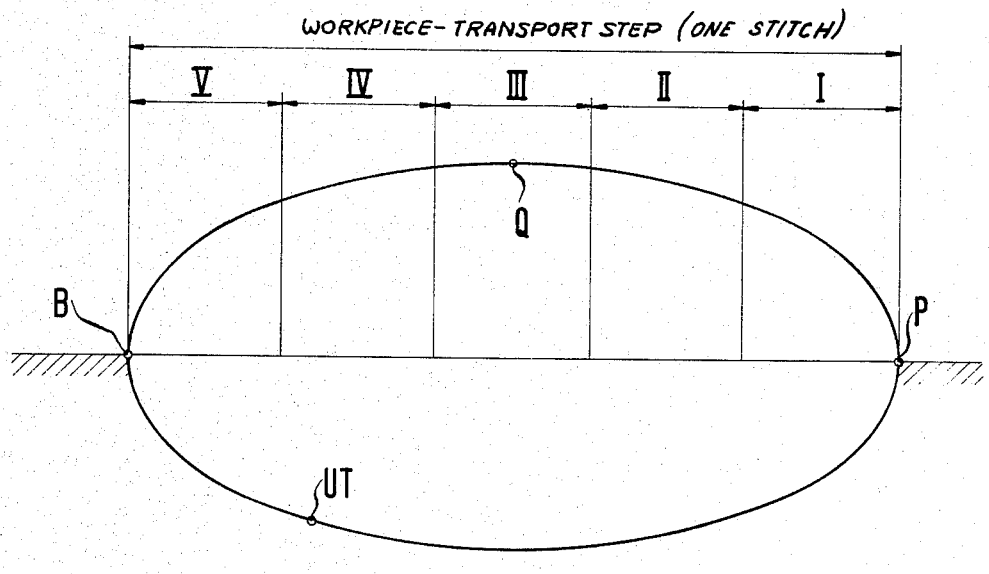
FIG. 2
FIG. 3
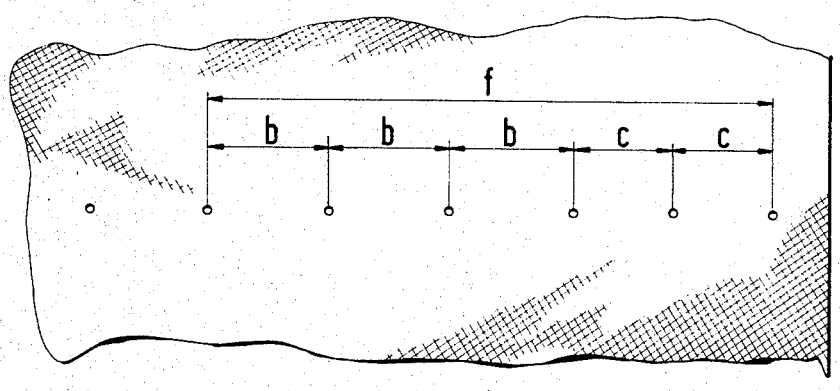

STITCH CORRECTION METHOD AND APPARATUS FOR A SEWING MACHINE

FIELD OF THE INVENTION

My present invention relates to a stitch correction method and device for use with a sewing machine and, more particularly, to a method and positioning device for ensuring that the last penetration of a fabric workpiece by a sewing machine needle will be at a predetermined point in the workpiece in the sewing of a particular row of stitches.

BACKGROUND OF THE INVENTION

Reference may be made to U.S. Pat. No. 4,381,719 which issued May 3, 1983 and to the corresponding German open application DE-OS No. 30 18 797.

These documents describe a method of and a positioning device for correcting at least some of the stitches of a given stitch row, utilizing stitch counting, so that the stitch row will end at a predetermined point of a fabric workpiece.

That system operates with a sewing machine which, apart from the correction means, may be of conventional design, i.e. can have a worktable over which the workpiece, e.g. a garment, can be moved and which is overhung by the head of the sewing machine which is carried by the sewing machine arm. The latter, in turn, extends horizontally toward a stitching location from the post of the sewing machine.

The head is usually provided with an upright needle bar which can be displaced upwardly and downwardly, e.g. by an arm mechanism so that a needle carried by this bar will pierce the workpiece and produce a row of stitches therein as the workpiece is moved past the stitching location by fabric-feed dogs or some other transport device usually provided beneath the workpiece adjacent the stitching location.

Such fabric feed dogs are given a compound movement, e.g. by a shaft under the table, and connected to the arm shaft through a mechanism in the post which may be driven by an electric motor. Usually the dog rises through a slot in a stitch plate which is set into the worktable and, in engagement with the underside of the fabric, moves in a fabric-feed direction before it retracts beneath the surface of the stitch plate to rise again for another increment of displacement of the workpiece.

While other mechanisms may be provided on the machine, including thread tensioning devices and means for feeding an upper thread to the needle and for drawing the thread taut to ensure tight stitching, means for correlating the motion of the dog with that of the needle to produce stitches of predetermined or adjustable length and means below the stitch plate to assist in stitch formation, the only other part of a standard machine which is necessary for an understanding of this invention is the presser foot which is also mounted in the head of the arm, generally straddles the stitching location, and yieldably holds the workpiece against the fabric feed dog so that a practically positive engagement of the fabric is ensured for the advance thereof.

It is important, for reasons discussed in the aforementioned U.S. patent and the German open application, to be able to terminate a given row of stitches at a predetermined point in the workpiece, e.g. at a predetermined distance from a fold or edge. A typical case is the sewing of a label on a garment.

To this end it is known to provide a photoelectric detection of the fabric edge or fold and to provide, on the arm shaft of the sewing machine, on which the needle bar cam may be mounted, appropriate markings which can be photoelectrically sensed to generate a train of pulses representing the angular displacement of the arm shaft and hence the position of the needle and the number of stitches produced by the successive up-and-down displacements of the needle bar.

A counting device which can include a counter responds to the photoelectric signals to compensate in the row of stitches so as to bring about a termination of this row of stitches at a predetermined time or after the row has been stitched through a predetermined distance, thereby ensuring that the last penetration of the needle in a stitch-forming mode will be at the predetermined location with respect to the photoelectrically detected reference, namely, the edge or the fold.

In the system described in this patent and the open application, the arm shaft has two marks which are photoelectrically detected and which each extend over 180°, one of these marks being reflective and the other being nonreflective. The output of the photoelectric detector is applied to a stitch counter and depending upon the position of the shaft, a determination is made as to whether n additional stitches should be generated to the end of the row or whether this row should be limited to $n-1$ stitches, where n is of course an integer.

In this system each stitch row will end at the predetermined location with a tolerance or variation of ± one-half stitch length. Stated otherwise, if a set point location is established, the actual end of the stitch row will be at a maximum ± half of a stitch length from the set point.

While this may not seem like much of a deviation, it represents a high degree of imprecision which is undesirable in accurate sewing.

It has also been proposed to provide a control system for a sewing machine which permits more exact row length and more precise terminal needle penetrations to be ensured. Such sewing machines are described, for example, in the open Europatent application EP-OS No. 0 044 648. This sewing machine utilizes a variable speed electric motor which is controlled by a counting device for mounting the number of sewn stitches and with sensors for the workpiece edge. The microprocessor-controller establishes the last needle penetration by breaking down the count into increments and reducing the speed of the sewing machine so that a programmed number of stitches at the reduced speed are sewn to a predetermined end of the row.

An adaptive algorithm can be used to increase the precision by varying the row length because with this system it is possible to reduce the stitch length so that, for example, a terminal stitch of half the stitch length can be sewn.

In many stitching applications, especially for decorative rows of stitching, a terminal stitch which is only half as long as the other stitches is undesirable and the problem is more pronounced as the selected stitch length is greater. This control system is also comparatively expensive.

OBJECTS OF THE INVENTION

It is the principal object of the present invention to provide an improved sewing machine with a stitch counter and correction unit whereby the disadvantages described above can be obviated and, in particular, the problems hitherto encountered with the shortening of only the terminal stitch of a stich row can be eliminated.

Another object of this invention is to provide an improved method of operating a sewing machine whereby the last penetration of the needle in the forming of a stitch row can be precisely determined and nevertheless the apparent uniformity of the stitches of this row can be maintained.

It is also an object of this invention to provide an improved method and positioning device for the terminal needle penetration of a stitch row on a sewing machine which will prevent unaesthetic appearances of the final stitch length by contrast with the length of other stitches along the row.

SUMMARY OF THE INVENTION

These objects and others which will become apparent hereinafter are attained, in accordance with the present invention, in a method and device for determining the location of the last needle penetration in the formation of a stitch row on a sewing machine equipped with a photoelectric detector of the rotation of the arm shaft and means for detecting a reference location on the workpiece, e.g. the aforementioned edge or fold, wherein after the detection of this reference location and generally after reduction of the sewing speed, a series of stitches up to the terminal needle penetration are sewn with varying stitch length but for a constant number of stitches so that the stitch combination can include stitches of the predetermined or preselected stitch length and/or stitches where the stitch length varies by a predetermined amount so that the remaining portion of the row or stitches has at least an appearance of regularity and uniformity.

With the method and the device of the invention, ahead of a predetermined terminal point of the stitch row, a stitch combination is sewn which consists of a constant number of stitches but of which the stitches can have varying lengths so that the total of such lengths is equal to the distance from the start of the combination to the predetermined termination point and the termination point is reached with a relatively high degree of accuracy.

This triggering of the stitch combination is automatically effected by the photoelectric detection of the reference point of the workpiece, e.g. the edge or a fold and in accordance with the detection of the instantaneous position of the arm shaft, these two inputs providing guiding instructions controlling the subsequent steps of workpiece advance from an electronic control to incrementally displace the workpiece over the predetermined number of successive steps with the appropriate displacements.

More particularly, the invention provides for the subdivision of each workpiece transport step of predetermined stitch length, into a multiplicity of segments, each of these segments being adapted to be selected to be present in a stitch combination of a constant number of stitches of a preselected stitch length or stitches deviating therefrom by a fixed amount which can represent an integral numbers of such increments. The instantaneous position of the arm shaft and hence the position of the needle, upon the detection of the edge or fold of the workpiece, is utilized to select from the memory of the electronic controller, previously preprogrammed, a selection of the stitch length for the combination of stitches necessary to reach the predetermined termination.

It has been found to be advantageous to subdivide the transport steps of predetermined stitch length each into a multiplicity of equal length segments.

In the apparatus aspects of the invention, in addition to a position detector for the angular position of the arm shaft, which can divide a full rotation thereof into a multiplicity of equal-angle increments, each representing an increment of a stitch length or fabric feed cycle because of the coupling of the feed dog with the arm shaft, I may provide means for controlling the stitch length to select a given stitch length and means for varying the stitch-length controlled by the electronic circuit so that the stitch length of the fixed number of terminal stitches can be varied in the desired combinations.

BRIEF DESCRIPTION OF THE DRAWING

The above and other objects, features and advantages of the present invention will become more readily apparent from the following description, reference being made to the accompanying drawing in which:

FIG. 2 is a diagram of the elliptical path of the toothed portion of a feed dog for affecting the advance of the fabric for each stitch; and FIG. 3 is a diagram of the stitch pattern produced in accordance with the present invention.

SPECIFIC DESCRIPTION

Figure 1:
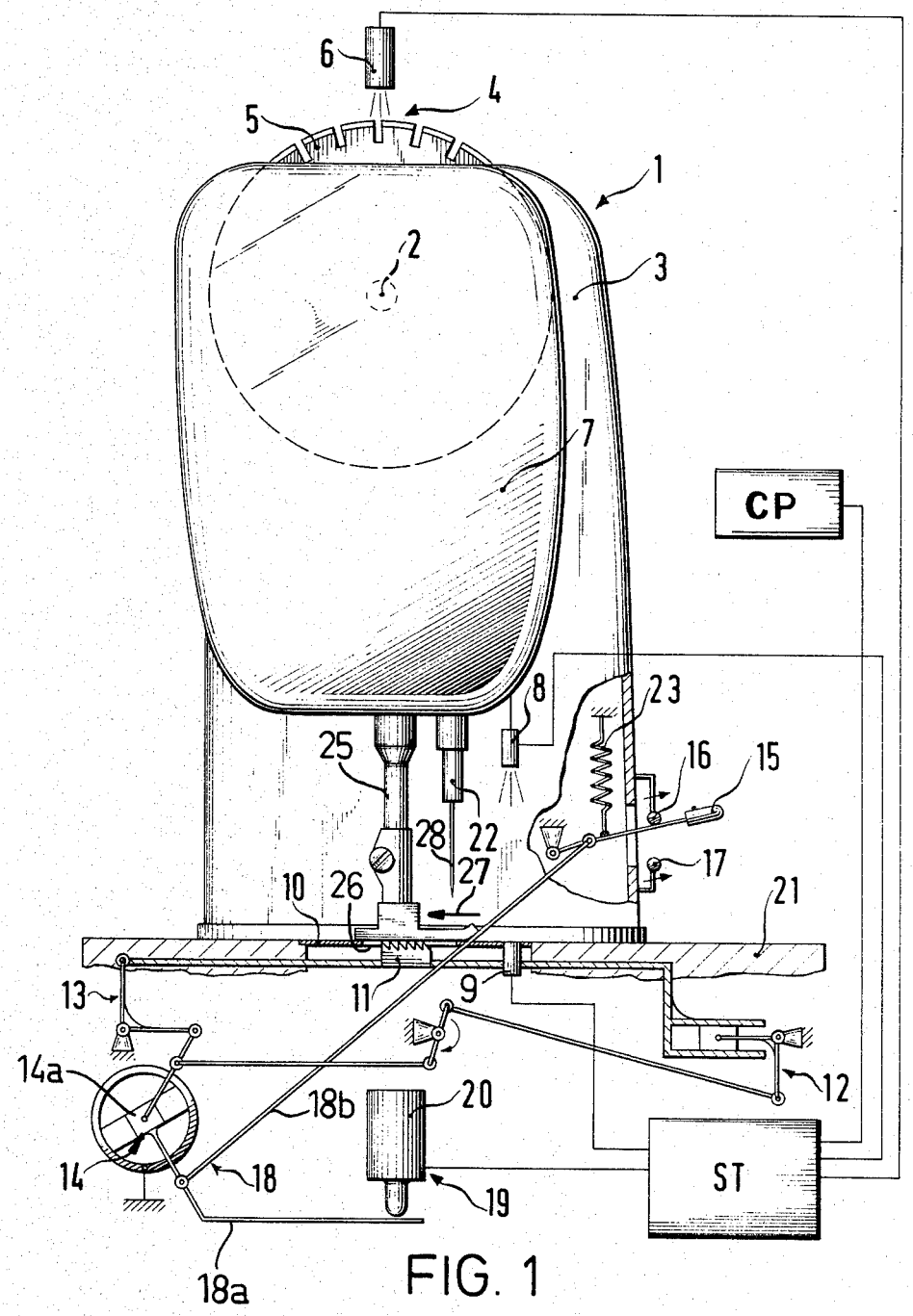
FIG. 1 is an end view, partly broken away, of a sewing machine with conventional portions thereof shown in simplified form and illustrating the control means of the present invention highly diagrammatically.

In FIG. 1, I have shown the upper part of an industrial sewing machine which, apart from the elements described herein, can be of conventional design.

This sewing machine can have the usual drive, a worktable 21, from which the post 3 extends upwardly, a stitch plate 10 provided on this worktable, the usual bobbin and stitch former below the stitch plate and a presser foot 25 which can be raised or lowered and which is generally biased downwardly to hold the workpiece not shown in FIG. 1 against the stitch plate 10. The latter is provided with a slot 26 in which the dog 11 can rise in its elliptical movement to engage the underside of the workpiece and advance it in the fabric feed direction shown by the arrow 27 in feed steps which correspond to the stitch length. The stitch plate also is generally formed with a hole straddled by the presser foot and through which the needle 28 passes on penetration of the fabric in the stitch-forming process.

The drive motor, the transmission connecting the drive motor to the arm shaft, which has been represented only by the axis 2, the cam assembly on the cam shaft for reciprocating the needle bar 22, the mechanism coupling the arm shaft with the dog 11, the bobbin mechanism below the stitch plate, the thread feed guides and tensioning devices, and the means for raising and lowering the presser foot have not been illustrated since they are conventional in the art and are not pertinent to the improvement of the present invention.

On the arm shaft 2 and the machine post 3 a position-and-pulse generator 4 is provided, the particulars of which will be apparent from the U.S. Pat. No. 4,381,719. More specifically this position-and-pulse generator comprises two sensing systems which may be represented collectively at 4 and can be combined or separate. One system signals an angle setting of the arm shaft and counts the stitches while the other system is an angle pulse generator providing a predetermined number of pulses per revolution of the shaft, thereby providing one pulse per increment of a revolution. For example, the pulse generator can break each rotation of the arm shaft into, say, 240 increments with the emission of a pulse for each increment.

As a rule the sensor 4 can comprise two discs disposed one behind the other on the arm shaft and represented by the single disc shown at 5. Each disc cooperates with a respective photoelectric pick-up (one of which is seen in 6) and is provided with the requisite marks (slits, notches, etc) which can be photoelectrically sensed to generate the pulses. The principles of such sensors will be apparent from U.S. Pat. No. 4,381,719.

Ahead of the sewing location, preferably on the arm head 7, I provide an adjustably positioned photoelectric pick-up formed by a transmitter 8 and a receiver 9. Naturally, a reflective photoelectric pick-up can be used, the receiver 9 can be disposed adjacent the light source 8 to pick up reflected light from a mirror or other reflective surface on the table 21 or the stitch plate 10. This pick-up can be used to ascertain the reference point on the fabric workpiece to be sewn, i.e. the edge or fold from which the stitch row is to terminate at a predetermined distance.

Preferably, the receiver 9 is disposed in or on the stitch plate 10 and is so positioned that it does not interfere with the movement of the fabric feed dog or a mechanism for displacing same.

The fabric feed dog 11 is given a composite movement which is elliptical in a vertical plane by a lever drive 12 which generates a rising and descending component, and a further lever drive 13 which generates a back-and-forth component with respect to the fabric feed direction. To permit adjustment of each fabric feed stroke and hence the stitch length, a conventional length setting mechanism 18 is provided.

This mechanism can include a slide eccentric 14, best described as a guide for a slide body whose angular tilt can be adjusted to vary the throw of the lower mechanisms coupled thereto. The adjustable slide 14 has a slide block **14*a* which is pivotally connected to the lever mechanism 13 and has its inclination or throw adjusted by the stitch setting lever 15**.

The latter can have a handle which projects outward of the post 3 through a slot and has its movement limited by two adjustably positionable stops 16 and 17 on the post. The lever 15 is biased by a spring 23 against the abutment 16.

A second device 19 also has an effect upon the stitch length. The device 19 comprises a driver or motor 20, e.g. a servomotor, electromagnetically controlled motor or a fluid operated motor, preferably a fluid operated cylinder controlled by a magnetic valve or a solenoid which is mounted upon the table 21 and forms an adjustably positioned stop for a lever **18*a* coupling the rod 18*b* to the slide 14*a* of member 14. This motor can displace the lever 18*a*** by a predetermined amount when actuated to deduct the predetermined amount from the set stitch length.

To increase the precision, motor and machine controller ST can have a microprocessor based central processing unit which is programmed so that the action of the driver 20 upon the stitch length is only effective in a lowered position of the feed dog 11.

The machine is operated utilizing conventional position response control technology. Selector switches can be provided on a control panel CP visible to the operator or forming part of the controller ST, and provide an output to the controller, and other controls can be provided on the unit ST as long as the latter is accessible to the operator.

Those aspects of the controller operation which are common to conventional machine operations need not be described. For example, the controller and the panel can operate in the usual manner for the lifting and operating of the presser foot, to hold a needle in an upper position for movement of the fabric into position, for lowering of the presser foot when the fabric is positioned and for starting the machine and beginning the sewing operation for a particular seam. Naturally, the stitch length can also be set for such conventional operation. According to the invention, moreover, and as described in the aforementioned patent, the operator can also set the desired distance at which the stitch row should terminate from the edge of the fabric, i.e. the reference point, and hence the point at which the last needle penetration shall occur.

Initially each fabric feed step, whose dimension can be selected as required for the particular sewing operation, is divided into a plurality of step segments.

In the illustrated embodiment, the transport step is identical to a preselected stitch length of 3 mm. According to the invention, each transport step is divided into a multiplicity of equal-length segments I–V illustrated in FIG. 2. These five segments each have a length of 0.6 mm. Each segment, in turn, is associated with a predetermined number of increments. For example, if a complete revolution of the arm shaft represents 240 increments and a complete cycle of displacement of the dog 11 represents 240 increments for a complete stitch cycle, each of the segments I through V can be subdivided into 48 increments.

Each of these increments is represented by a pulse generated by the interaction of the disc 5 and the photoelectric detector 6.

When the photoelectric detector 8, 9 detects the trailing fabric edge or a fold, i.e. the reference point mentioned previously, the counting of the increments from a reference point is enabled and the count is accumulated in the microprocessor and controller. The fold is detected generally when a small article, such as a label, is to be sewn on a larger article.

Counter accumulation has been described in the aforementioned patent.

In the example given here, the starting point over which the count is accumulated is the lower feedpoint B of the needle bar 22 and the position of the dog at this lower feedpoint has been represented at UT in FIG. 2.

The thus accumulated count is subtracted from the total count, namely 240.

Since the increments associated with each segment are stored in the electronic memory, it is possible to determine exactly the point in a particular segment at which the reference edge was detected by the photoelectric device 8,9.

From this point of the detection of the reference edge to the lower dead point or starting point B, the corresponding number of complete segments must be deducted from the row of stitches to be sewn, i.e. from the five stitches to be made between this detection and the last penetration of the needle through the fabric (see FIG. 3).

If the reference detection is at point P (FIG. 2) a complete transport step or one stitch must be deducted.

In this case, each of the five stitches can be reduced in length by 20% to subtract the number of increments corresponding to a full stitch therefrom or, phrased otherwise, one segment must be deducted from each of the five stitches and by appropriate reduction of increments the stitch lengths of 3 mm for each of five remaining stitches is reduced to 2.4 mm and this assumes, therefore, that from the detection point to the row termination, five stitches will be formed in a distance of 12 mm or 15 mm from the starting point B. The last needle penetration is at the predetermined location and the stitch row shows five terminal stitches each of which has been dimensioned with respect to the preset stitch length of only 20% thereby affording a highly regular appearance.

When the detection of the reference edge occurs at the point Q in the path of the feed dog and the needle, namely in the segment III, the number of segments from detection to the starting point B is only two full segments or a distance of $2\times0.6=1.2$ mm. If the five stitches are then formed at full length, the last needle penetration will lie 1.2 mm beyond the predetermined point of final needle penetration and thus it is necessary to reduce the final penetration of the row by 1.2 mm in length.

From the memory, the controller recognizes that this is equivalent to the sewing of three stitches with the original stitch length of 3 mm and two stitches with the stitch length reduced by the predetermined amount of 0.6 mm, namely, two stitches with a length of 2.4 mm.

The stitch row has been represented in FIG. 3.

For varying deficits of the row to be stitched, the memory is programmed with characteristic stitch combinations of which some samples are given in the following table.

The following values and headings of the table are deserving of note:

a = theoretical length of stitch row of the group of stitches to be affected by the selected stitch combination, for example $a=n_1\times b=5\times3=15$ mm $n_1$ = constant number of stitches of the portion of the stitch row to be affected after detection of the reference point of the workpiece.

$n_2$ = number of stitches with stitch length b.

$n_3$ = number of stitches with stitch length c.

b = preselected stitch length.

c = stitch length after reduction by fixed amount.

$n_4$ = number of segments in a fabric feed step.

d = length of segments = b:$n_4$.

A = point of detection of feed edge in segments I . . . V.

B = end of the transport step in which A lies.

$n_5$ = number of full segments between A and B.

e = length to be deducted over the row ($d\times n_5$).

f = actual length of row to be stitched to desired end point = $n_2\times b+n_3\times c$.

g = total length of row from detection point = $e+f$.

Characteristics of examples:

$n_1=n_2+n_3=5$ b = 3 mm c = b − 20% = 2.4 mm.

| desired a mm | $n_1$ | b mm | c mm | $n_4$ | d mm | A | $n_5$ | e $d\times n_5$ mm | Stitch combination $n_1$ | $n_3$ | f = $n_2\times b+n_3\times c$ mm | actual g = e + f mm |
|---|---|---|---|---|---|---|---|---|---|---|---|---|
| 15 | 5 | 3 | 2.4 | 5 | 0.6 | I | 4 | 2.4 | 1 | 4 | 3 + 9.6 = 12.6 | 15 |
| 15 | 5 | 3 | 2.4 | 5 | 0.6 | II | 3 | 1.8 | 2 | 3 | 6 + 7.2 = 13.2 | 15 |
| 15 | 5 | 3 | 2.4 | 5 | 0.6 | III | 2 | 1.2 | 3 | 2 | 9 + 4.8 = 13.8 | 15 |
| 15 | 5 | 3 | 2.4 | 5 | 0.6 | IV | 1 | 0.6 | 4 | 1 | 12 + 2.4 = 14.4 | 15 |
| 15 | 5 | 3 | 2.4 | 5 | 0.6 | V | 0 | 0 | 5 | 0 | 15 + 0 = 15 | 15 |

Since the detection of the fabric edge can occur in the region of the start or end of a row, an unavoidable error can result because of a deviation of the actual starting point from the desired starting point. This error, however, is smaller than the number of segments to which the feed steps divided is increased.

From the foregoing table it is apparent that the desired or set point state will correspond to the actual value, i.e. the result so that the last needle penetration can be accurately positioned in the fabric. The means for setting the stitch length represented at 18 is, of course, known and need not be described in any detail. The second device 19 for varying stitch length by a freely selectable but predetermined amount utilized the selective actuation of the motor 20 and the variation in the position of the arm 18*a*.

I claim:

1. A method of terminating a stitch row in a workpiece at a predetermined location short of a reference point thereon, which comprises the steps of:

(a) in a stepwise manner displacing said workpiece past a stitching location at which a sewing machine needle penetrates said workpiece in transport steps synchronized with the displacement of said needle and each resulting in the formation of a stitch of an original length of said row;

(b) subdividing each of said transport steps into a multiplicity of segments and generating for each of said segments a train of countable pulses;

(c) detecting the passage of said reference point past a location at a predetermined distance from said needle and initiating a count of said pulses upon such detection;

(d) counting the pulses from the start of each stitch to a point in the transport step during which count initiation is commenced in step (c) to provide a count representing the segment of the latter transport step at which the count was initiated;

(e) continuing to sew a fixed number of stitches from the time of said detection in said row; and (f) controlling the stitch length of said fixed number of stitches so that said fixed number of stitches constitutes a stitch combination of stitches which may be of the original length reduced by a fixed amount so that based upon the counts, the stitch combination is selected which has a total length ensuring a last penetration of said needle into said workpiece for said row at said predetermined location on said workpiece, a series of such stitch combinations being stored in an electronic memory and the selected stitch combination being recalled from said memory based upon said counts.

2. The method defined in claim 1 wherein said sengments are of equal length for each transport step.

3. The method defined in claim 2 wherein each transport step is divided into five segments and each stitch is associated with 240 increments for each rotation of a machine arm shaft displacing said needle.

4. In a sewing machine having a worktable provided with a stitch plate, an arm overhanging said stitch plate, a needle bar carrying a needle and reciprocated upwardly and downwardly on said arm, an arm shaft operatively connected with said needle bar for reciprocating said needle, a feed dog engageable with a workpiece through said stitch plate, and a meachanism coupling said feed dog with said shaft so that said feed dog is displaced in an elliptical path for each transport step of said workpiece, the improvement which comprises in combination:

signal generating means for generating a train of countable pulses each representing an increment of angular displacement of said shaft, said step being divided into a plurality of segments and each of said segments being associated with a multiplicity of said pulses whereby said pulses represent corresponding increments of each segment;

means for detecting a reference point on said workpiece in the formation of a row of stitches by the advance of said workpiece in a corresponding number of steps on said stitch plate and successive penetration of said needle through said workpiece;

means responsive to the detection of said reference point for initiating a count of said pulses and for terminating said count upon the attainment of a reference poisition by said needle whereby the count represents the segment of said step at which said reference point was detected;

a memory for storing for a given number of stitches a multiplicity of stitch-length combinations depending upon the segment at which said reference point was detected such that each stitch-length combination can include stitches of an original length and stitches of the original length diminished by a fixed value so that, upon selection of a stitch length combination corresponding to the count, said row will be completed by the fixed number of stitches with the individual length of the stitches of said fixed number depending upon the stitch-length combination; and control means responsive to said count for selecting the particular stitch-length combination from said memory and controlling said machine to vary the stitch length for the stitches of the selective combination, thereby terminating the row at a predetermined distance from this reference point.

5. The improvement defined in claim 4 wherein the control means includes a driver acting upon said mechanism to vary the length of stitches sewn by said machine.

6. The improvement defined in claim 5 wherein said driver is a fluid pressure cylinder controlled by a magnetic valve.

7. The improvement defined in claim 5 wherein said driver is an electromagnet.

8. The improvement defined in claim 5 wherein said mechanism includes an angularly displaceable guide having a slide interposed between said dog and said shaft, said driver controlling the angular displacement of said slide.

9. The improvement defined in claim 5 wherein said shaft is provided with at least one disc having a multiplicity of markings and cooperating with a photoelectric pick-up for generating said train of pulses.

10. The improvement defined in claim 5 wherein the means for detecting said reference point includes a photoelectric detector on said arm.

11. The improvement defined in claim 5 wherein said mechanism includes means for controlling the original stitch length.

* * * * *